United States Patent [19]

Takemoto

[11] Patent Number: 4,708,501

[45] Date of Patent: Nov. 24, 1987

[54] ELECTROMAGNETIC HAMMER PRINTING DEVICE INCLUDING A LIMITED ACTION SPRING FORCE

[75] Inventor: Takeshi Takemoto, Yamato, Japan

[73] Assignee: Ricoh Company, Ltd., Tokyo, Japan

[21] Appl. No.: 898,727

[22] Filed: Aug. 14, 1986

Related U.S. Application Data

[63] Continuation of Ser. No. 654,259, Sep. 25, 1984, abandoned.

[30] Foreign Application Priority Data

| | | | |
|---|---|---|---|
| Sep. 26, 1983 | [JP] | Japan | 58-177669 |
| Sep. 26, 1983 | [JP] | Japan | 58-177668 |
| Sep. 26, 1983 | [JP] | Japan | 58-148385[U] |
| Sep. 30, 1983 | [JP] | Japan | 58-151740[U] |
| Oct. 6, 1983 | [JP] | Japan | 58-155580[U] |
| Oct. 6, 1983 | [JP] | Japan | 58-155581[U] |

[51] Int. Cl.[4] ..... B41J 9/38

[52] U.S. Cl. ..... 400/157.2; 400/167; 101/93.29; 101/93.48

[58] Field of Search ..... 101/93.02, 93.19, 93.29, 101/93.34, 93.48; 400/157.1, 157.2, 167; 335/222, 227, 229, 230, 256, 257

[56] References Cited

U.S. PATENT DOCUMENTS

| | | | |
|---|---|---|---|
| 3,568,593 | 3/1971 | Papadopoulas | 101/93.34 |
| 4,221,163 | 9/1980 | Anderson | 101/93.29 X |
| 4,258,371 | 3/1981 | Sekine et al. | 101/DIG. 13 X |
| 4,290,356 | 9/1981 | Hehl | 101/93.34 |
| 4,389,131 | 6/1983 | Kondo et al. | 101/93.29 X |
| 4,422,784 | 12/1983 | Arzoumanian et al. | 101/93.48 X |
| 4,496,253 | 1/1985 | Morsing | 400/157.2 X |

*Primary Examiner*—Edgar S. Burr

*Assistant Examiner*—David A. Wiecking

*Attorney, Agent, or Firm*—Cooper, Dunham, Griffin & Moran

[57] ABSTRACT

An electromagnetic printing hammer device including a permanent magnet having a pair of electromagnetic pole-faces spaced apart from each other by a gap. A hammering element formed of a permanent magnet at least in one portion thereof is located in the gap for movement in a plane parallel to the pole-faces. The hammering element exerts a force of impact on the back of a type as a thrust is applied thereon when a pulse current is passed to the electromagnet and supported by bearings for linear movement in a direction in which it exerts a force of impact.

The features of the hammer device include any one of the followings:

(a) a spring providing an initial force to urge the hammering element in a direction in which a thrust is applied thereto;

(b) a rear end of the permanent magnet passing through the gap at least immediately before the exertion of the force of impact by the hammering element is finished;

(c) the yokes constituting the electromagnetic poles extending from electromagnetic coils in the same direction as the direction of movement of the hammering element;

(d) the permanent magnet and the pole-faces differing from each other in height;

(e) the permanent magnet being formed of a plastic magnet;

(f) a rear end of the permanent magnet and that of the pole-faces being spaced apart from each other by a spacing interval of uneven distance; and (g) a stopper to halt the spring force before type face impact.

7 Claims, 17 Drawing Figures

ELECTROMAGNETIC HAMMER PRINTING DEVICE INCLUDING A LIMITED ACTION SPRING FORCE

This is a continuation application from application Ser. No. 654,259, filed Sept. 25, 1984, now abandoned.

BACKGROUND OF THE INVENTION

This invention relates to an electromagnetic printing hammer device of a serial impact printer comprising a hammering element driven by an electromagnetic force to strike the back of each one of types arranged on a type wheel to print a symbol on a sheet wound on a platen.

In one type of serial impact printer known in the art, a petal type print wheel, such as a disc type print wheel, usually referred to as a daisy wheel, which comprises a multiplicy of types arranged on the circumference of an imaginary circle and each supported at a forward end of one of a multiplicity of types arranged on the circumference of an imaginary circle and each supported at a forward end of one of a multiplicity of spokes extending radially from the center of the imaginary circle, is connected to a shaft of a selection motor and angularly rotated by the action of the selection motor in accordance with a printing signal, to bring one of the types corresponding to the printing signal to a printing position in which the back of the type is struck by a hammering element to bring its type face into abutting engagement through an ink ribbon with a sheet wound on the platen, to perform printing of the desired character.

One type of printing hammer device is known for accomplishing the object of performing printing by using the daisy wheel referred to hereinabove in which an electromagnetic coil is wound on a yoke which is formed at opposite ends with a pair of electromagentic poles positioned opposite each other, and a member formed of a permanent magnet at least in one portion thereof is interposed between the electromagnetic poles in a gap defined therebetween for movement. In this type of printing hammer device, the member is moved by the magnetic attraction and magnetic repulsion that take place between the parmanent magnet of the member and the electromagnetic poles as a pulse current is passed to the coil, so that the member can serve as a printing hammer element.

FIG. 1*a* shows one example of this type of printing hammer device of the prior art. As shown, a coil $C_1$ is wound on a yoke to provide an electromagnet having two poles a and b positioned opposite each other and defining a gap C therebetween in which a permanent magnet d is located between the two poles a and b to serve as a hammering element e. The hammering element e is supported for pivotal movement about a shaft f spaced apart from the gap C. The hammering element e moves in pivotal movement about the shaft f, so that the permanent magnet d also moves in circular movement in the same direction as the hammering element e. Because of this, the magnetism in the gap C and the magnetism of the permanent magnet d which repulse each other could not cross each other linearly, thereby making it possible to provide an effective thrust to the hammering element e. This would reduce the striking force with which printing is carried out by the action of the hammering element. Thus, to increase the striking force of the hammering element e, it would be necessary either to increase the value of the current passed to the coil $C_1$ or to increase the magnetic force of the permanent magnet d.

To increase the value of a current passed to the coil $C_1$ would be undesirable, because the coil and wires would have to have their capacities increased and power consumption would rise. This would make it necessary to increase the size of the electromagnetic printing hammer device, and means would have to be provided for dissipating heat which would increase in amount as power consumption rises.

Meanwhile, there are limits to the degree to which the magnetic force of the permanent magnet d can be increased even if a rare earth magnet were used.

The increase in power consumption noted hereinabove would be a disadvantage in the case of equipment using an electromagnetic printing hammer device. An increase in the size and weight of the electromagnetic printing hammer device would have the disadvantage that it runs counter to the tendency of the equipment using such hammer device becoming smaller in size and lighter in weight.

FIG. 1*b* shows a permanent magnet in which electromagnetic poles h and a yoke h' provided with a coil i are in staggered relation. In a magnet of the type in which the yoke h' is as shown, a leak magnetic flux of the coil i would exert influences on a permanent magnet j of the hammer section located in a magnetic field in addition to a thrust I, so that a force oriented in the direction of an arrow II would act thereon. Thus, a force that is wasted would be generated by the permanent magnet j in addition to the thrust I. Because of this, the hammer section of the permanent magnet shown in FIG. 1*b* has suffered the disadvantage that the thrust of the hammer section having the permanent magnet tends to be wasted.

SUMMARY OF THE INVENTION

This invention has been developed for the purpose of solving the aforesaid problems of the prior art. Accordingly, the invention has as its object the provision of an electromagnetic printing hammer device which is capable of increasing the the force of an impact given by the hammering element to the back of each type by a linear movement and by avoiding a loss of thrust applied to the hammering element without increasing the size of an electromagnetic mechanism and which is capable of reducing power consumption by reducing the value of a pulse current passed to the coil of the electromagnetic mechanism.

To accomplish the aforesaid object, the invention provides an electromagnetic printing hammer device comprising yokes having electromagnetic coils wound thereon to provide an electromagnet having a pair of electromagnetic pole-faces located at opposite ends of the yokes and spaced apart from each other by a gap between the electromagnetic poles, and a hammering element formed of a permanent magnet at least in one portion thereof located in the gap between the electromagnetic pole-faces and movable in a plane parallel to the electromagnetic pole-faces, so that as a pulse current is passed to the electromagnetic coils, the hammering element is moved in the gap to perform a hammering action, wherein said hammering element is capable of a linear movement in a direction in which it applies a hammering impact, and a spring is mounted to the hammering element to urge same to perform a hammering action.

The aforesaid object can also be accomplished by supporting the hammering element for linear movement in a direction in which it performs a hammering action and providing the electromagnetic printing hammer device with any one of the following features:

(a) The hammering element is constructed such that in a stroke in which the hammering element moves in a hammering direction, the rear end of the permanent magnet has passed through the gap at least immediately before termination of application of an impact by the hammering element to the back of a type;

(b) The yokes constituting the electromagnetic poles extend from the position in which the coils are wound thereon in the same direction as the direction of movement of the hammering element in the form of a bullet;

(c) The permanent magnet and the electromagnetic pole-faces differ from each other in height as viewed in a direction which is substantially perpendicular to the direction in which the hammering element moves in a linear movement;

(d) The permanent magnet is formed of a plastic magnet, and (e) The rear end of the permanent magnet and the rear end of each of the electromagnetic pole-faces are not parallel to each other but they are spaced apart from each other by different distances in different positions.

DESCRIPTION OF THE PREFERRED EMBODIMENTS

Preferred embodiments of the invention will now be described by referring to the accompanying drawings.

Figure 3:
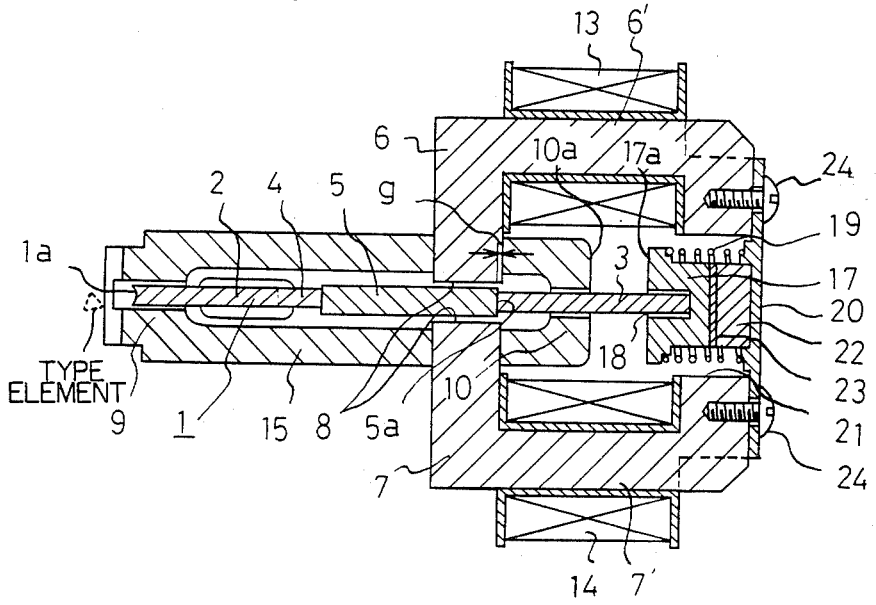
FIG. 3 is a transverse sectional view taken along the line III—III in FIG. 4.

FIGS. 2–6 show an electromagnetic printing hammer device A comprising a hammering element formed of nonmagnetic metal or plastic, which is formed of a plate in the embodiment shown. The hammering element 1 includes shaft portions 2 and 3 located at the front and rear respectively as viewed in a direction in which the hammering element 1 performs a hammering action (left and right sides respectively in the figure), and a frame portion 4 located in the middle between the front and rear shaft portions 2 and 3 to support a permanent magnet 5 also formed of a plate acting as a unit with each other. As shown in FIG. 3, the permanent magnet 5 is secured to the hammering element 1 in such a manner that the increased thickness pole-faces are attached to opposite surfaces of the frame portion 4 of the hammering element 1.

The hammering element 1 which is disposed in a magnetic field formed in a gap 8 defined between two electromagnetic poles 6 and 7 is journalled at the shaft portions 2 and 3 by bearings 9 and 10 respectively for forward and backward movements. The hammering element 1 is formed at its forward end 1a with a V-groove for engaging a projection formed at the back of each type to serve as a detent. the forward end 1a of the hammering element 1 may be of any other suitable shape that the V-groove.

As seen in a plan view, the electromagnetic printing hammer device comprises two yokes 6' and 7' each substantially in the form of a letter U in a lying position which are maintained in intimate contact with each other at their bases 6*a* and 7*a* through an interface 11 and secured together by screws 12 inserted in threaded apertures 12*a* in the bases 6*a* and 7*a*. Electromagnetic poles 6 and 7 are located at ends of the yokes 6' and 7' opposite the bases 6*a* and 7*a* respectively, the coils 13 and 14 are wound on the yokes 6' and 7' respectively.

In the aforesaid construction, the yokes 6' and 7' extend in the same direction as the movement of the hammering element 1 from the position in which the coils 13 and 14 are wound toward the electromagnetic poles 6 and 7. Thus, the magnetism generated when a pulse current is passed to the coils 13 and 14 produces a magnetic field in the gap 8 between the two electromagnetic poles 6 and 7 which has a magnitude corresponding to the value of the pulse current, so that almost all the magnetism produced by the coils 13 and 14 acts in a direction in which it applies a thrust to the hammering element 1.

The bearings 9 and 10 are formed of plastic material or nonmagnetic metal, and a frame 15 is screwed to the electromagnetic poles 6 and 7 to form a unit therewith. The numeral 16 designates a connection bracket. The bearings 9 and 10 are open at their upper ends to allow the hammering element 1 to be inserted through the open ends and removably mounted to the bearings 9 and 10.

The hammering element 1 journalled by the bearings 9 and 10 is free to move forwardly and rearwardly, and a rear end of the permanent magnet 5 is located in the gap 8 between the electromagnetic poles 6 and 7 (see FIG. 5) while a rear end of the shaft portion 3 is fitted in an engaging bore 18 formed in a movable spring rest 17 so that the hammering element 1 is urged at all times by the biasing force of a spring 19 to move in a direction in which the hammering element 1 exerts a force of impact (leftwardly in the figure). The spring is mounted between the movable spring rest 17 and a fixed spring rest 20, and the movable spring rest 17 and a spring 19 can move into and out of a through hole 21 formed in the bases 6*a* and 7*a* of the yoke 6' and 7' disposed opposite the electromagnetic poles 6 and 7. The fixed spring rest 20 has secured thereto in a position located at the center of the spring 19 a positioning member 22 for restricting a rearward position of the movable spring rest 17 or a rearward position of the hammering element 1. The positioning member 22 which is formed of rubber of low resilience or other suitable material for absorbing shock has a wear resistant member 23 bonded to a surface thereof with which the movable spring rest 17 comes into contact. The fixed spring rest 20 is screwed to the electromagnetic poles 6 and 7 as indicated at 24.

Figure 5:
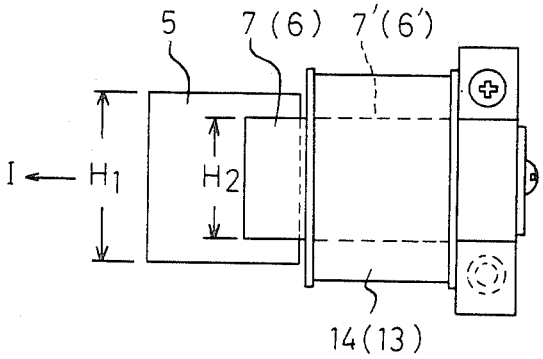
FIG. 5 is a side view showing the permanent magnet and the electromagnetic pole-faces in relation to each other.

In the electromagnetic printing hammer device of the aforesaid constructional form, the permanent magnet 5 has a height $H_1$ and the electromagnetic poles 6 and 7 have a height $H_2$, as shown in FIG. 5. By this arrangement, even if the vertical position of the permanent magnet 5 is slightly displaced relative to the vertical position of the electromagnetic poles 6 and 7 when the parts are assembled, a magnetic field produced can apply an effective thrust I to the hammering element 1 without the magnetism being deflected. By equalizing the magnetic reaction of the permanent magnet 5 with respect to the magnetic field produced by the electromagnetic poles 6 and 7 as described hereinabove, it is possible to positively avoid scattering of the thrust applied by the permanent magnet 5 when the force of impact is exerted by the hammering element 1. The difference between the permanent magnet 5 and pole-faces of electromagnetic poles 6 and 7 in height is not limited to the one shown and described hereinabove, so long as upper and lower zones thereof can act in magnetic fields of substantially the same intensity.

Figure 1A:
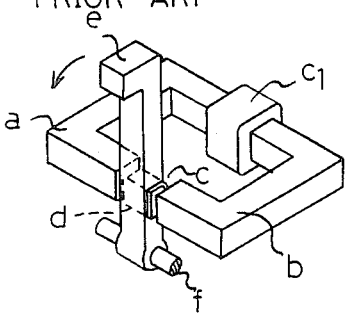
FIG. 1a PRIOR ART
FIGS. 1*a* and 1*b* are views in explanation of different examples of electromagnetic printing hammer device of the prior art.
Figure 1B:
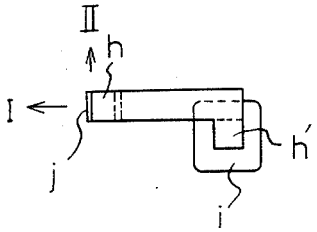
FIG. 1b PRIOR ART
Figure 2:
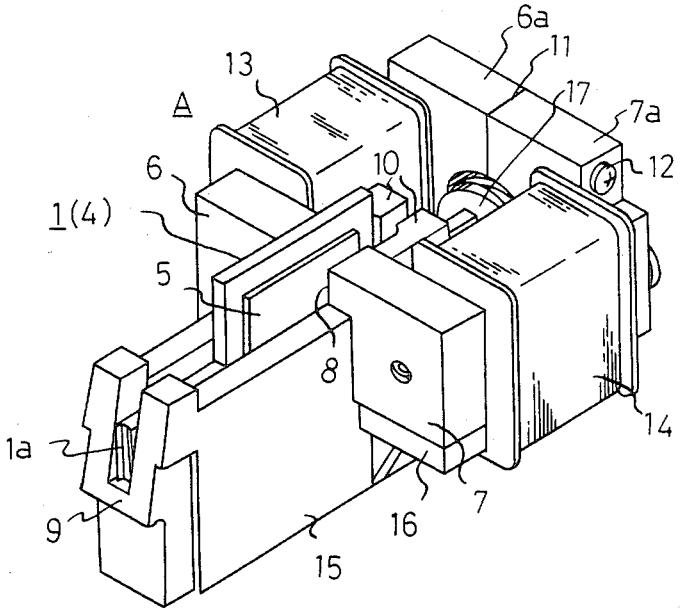
FIG. 2 is a perspective view of the electromagnetic printing hammer device comprising one embodiment of the invention.
Figure 6:
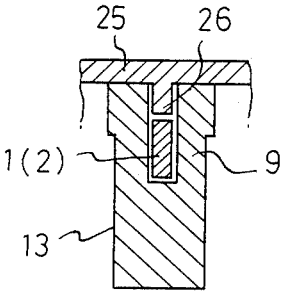
FIG. 6 is a sectional view taken along the line VI—VI in FIG. 4.

A cover is provided to the electromagnetic printing hammer device A, and the cover 25 shown in FIG. 6 is formed at its inner side with a projection 26 which is fitted in the upper open end of the bearing 9 of the hammering element 1 to guide its forward and rearward movements to prevent its dislodging from the bearing 9. The same projection is also provided to the cover 25 for the bearing 10. Coils 13 and 14 are wound on the electromagnetic poles 6 and 7 respectively. Only one coil may be provided as is the case with the example of the prior art shown in FIG. 1, in place of the two coils 13 and 14.

Figure 4:
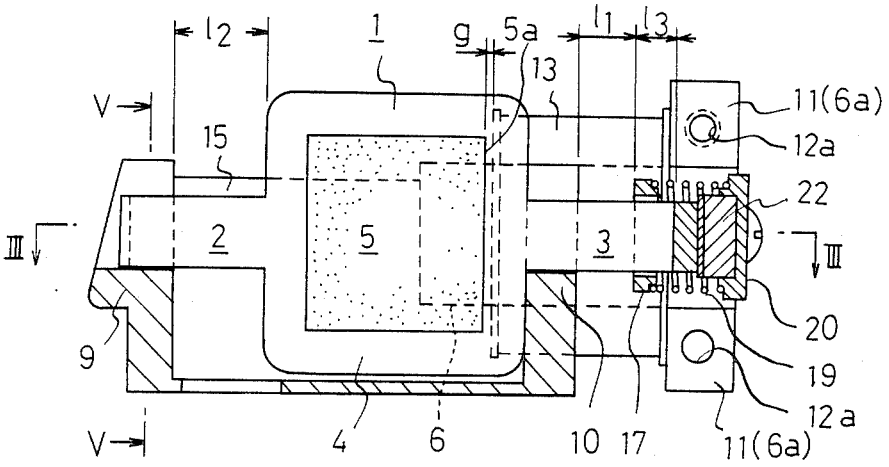
FIG. 4 is a substantially central vertical sectional view of the electromagnetic printing hammer device shown in FIG. 2, showing its essential portions.

Operation of the electromagnetic printing hammer device A of the aforesaid construction will be described. The electromagnetic poles 6 and 7 have no magnetism when no pulse current is passed to the coils 13 and 14, so that the hammering element 1 is attracted to the electromagnetic poles 6 and 7 by the magnetism of the permanent magnet 5. At this time, the rear end of the shaft portion 3 of the hammering element 1 is in engagement with the movable spring rest 17, and the attraction of the hammering element 1 to the electromagnetic poles 6 and 7 by the magnetism of the permanent magnet 5 compresses the spring 19, so that the rear face of the movable spring rest 17 is positioned against the front face of the positioning member 22. Thus, in its rearward standby position, the hammering element 1 compresses the spring 19 and is ready for forward movement as shown in FIGS. 3 and 4. To this end, the resilience of the spring 19 is set at a level lower than the force of attraction of the permanent magent 5, and a rear end 5*a* of the permanent magnet 5 is positioned slightly forward of the rear ends of the electromagnetic pole-faces 6 and 7 with a gap g when the hammering element 1 is disposed in its rearward standby position. Thus, the position in which the hammering element 1 is disposed with the gap g to be ready for forward movement in an operation commencing position of the hammering element 1.

As a pulse current is passed to the coils 13 and 14 while the hammering element 1 is in the operation commencing position, the electromagnetic poles 6 and 7 are excited and a magnetic field of the same pole as the magnetic pole of the permanent magnet 5 in the thickness direction is produced in the gap 8, so that the permanent magnet 5 is repulsed by the excited electromagnetic poles 6 and 7. Combined with the biasing force of the spring 19, this allows the hammering element 1 to leap forwardly from the operation commencing position. The polefaces of the electromagnetic poles 6 and 7 have the same width as the permanent magnet 5 of the hammering element 1 and they are aligned with each other at the central portion, so that the peak magnetic flux from the electromagnetic poles 6 and 7 acts with the permanent magnet 5 to increase the thrust applied to the hammering element 1. The permanent magnet 5 is distinct from the pole-faces of the electromagnetic poles 6 and 7 in height in a direction which is substantially perpendicular to the direction in which a force of impact is exerted by the hammering element 1. Thus, the permanent magnet positioned in the magnetic field of the electromagnetic poles 6 and 7 can act at its upper zone and lower zone in the magnetic fields of substantially the same intensity. This is conducive to elimination of a loss of thrust I in the direction in which the force of impact is exerted by the hammering element 1.

Figure 7:
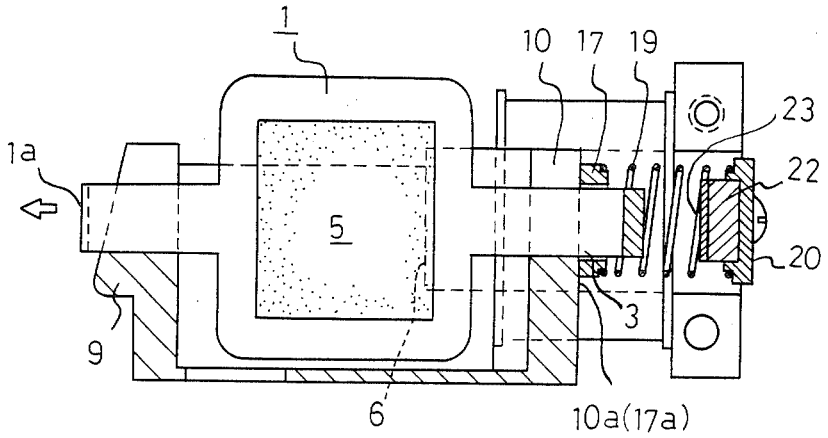
FIGS. 7 and 8 are views in explanation of the manner in which the hammering element applies an impact.
Figure 8:
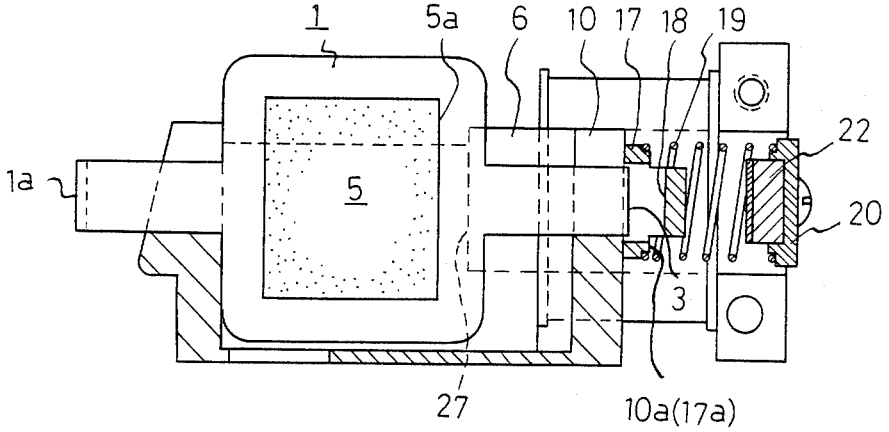

Meanwhile, the biasing force of the spring 19 applied to the hammering element 1 in its movement to leap forwardly forces the rear end of the shaft portion 3 of the hammering element 1 to move forwardly at the movable spring rest 17 until a front face 17*a* of the movable spring rest 17 is brought into abutting enagement with a rear face 10a of the bearing 10 (see FIG. 7). The movement of the hammering element 1 taking place at this time is a forced stroke l1 shown in FIG. 4. Then, the hammering element 1 is further thrusted in the direction in which it exerts a force of impact by the force of inertia produced in the hammering element 1 as the movable spring rest 17 abuts at its front face 17*a* against the rear face 10*a* of the permanent magnet 5 and the force of repulsion acting between the permanent magnet 5 and the electromagnetic poles 6 and 7, so that the rear end of the shaft portion 3 moves in sliding movement in the engaging hole 18 of the movable spring rest 17 to apply a thrust to the hammering element 1 (see FIG. 8). The movement of the hammering element 1 taking place at this time is a voluntary stroke l2 shown in FIG. 4. A rear end 5*a* of the permanent magnet 5 moves away from a forward end 27 of the pole-face of the electromagnetic poles 6 and 7 through the gap 8 in the direction in which the hammering element 1 exerts a force of impact. Thus, the hammering element 1 is able to exert a force of impact by inertia by suppressing as much as possible the attracting force of the permanent magnet 5 tending to move the hammering element 1 rearwardly. The shaft portion 3 is preferably slidingly engaged in the engaing hole 18 of the movable spring rest 17 in such a manner that when the hammering element 1 has moved forwardly through the voluntary stroke l2, the rear end of the shaft portion 3 is not dislodged from the movable spring rest 17 which is in the forced stroke l1 postion. Thus, the stroke of movement of the shaft portion 3 with respect to the movable spring rest 17 after its forward movement is interrupted may be within an engaging space l3, and the relation of the strokes may be selected freely when it is deemed necessary to do so in view of the movable stroke characteristic of the hammering element 1. Preferably, the relation of the strokes is $l2<l1+l3$. Also, when the hammering element 1 is thrusted forwardly by the force of inertia alone by letting the movement thereof corresponding to the voluntary stroke l2 taking place without any restraint, the following relation may be established: $l2>l1$. In this case, if the forced stroke l1 were too small, the force of inertia contributing to the thrust applied to the hammering element 1 would be reduced, thereby making it impossible to accomplish the object of cutting power consumption.

Meanwhile, if the forced stroke l1 were increased and made substantially equal to or greater than the voluntary stroke l2, it would become impossible to thrust the hammering element 1 forwardly by the force of inertia and at the same time it would become difficult to control the thrust applied to the hammering element 1. More specifically, control of the thrust applied to the hammering element 1 is usually effected by varying the value or the pulse duration of the current passed to the coils 13 and 14. However, if the biasing force of the spring 19 acts on the hammering element 1 through the whole voluntary stroke l2, then the thrust applied to the hammering element 1 is decided by the biasing force of the spring 19 and becomes substantially constant even if the electrical conditions, such as the value of the current, pulse duration, etc., are altered.

In the electromagnetic printing hammer device A of the aforesaid construction and operation, the hammering element 1 is restored to the operation commencing position shown in FIGS. 3 and 4, after it has exerted a force of impact on the back of a type, by the electromagnetic poles 6 and 7 being attracted to the permanent magnet 5 by the magnetism of the latter, as the electromagnetic coils which energize poles 6 and 7 are deexcited upon the current passed thereto being turned off and a reaction occurring in the hammering element 1 as it exerts the force of impact.

In the embodiment shown and described hereinabove, when the permanent magnet 5 of the hammering element 1 is formed of a plastic magnet or a rare earth plastic magnet, the hammering element 1 is light in weight and has high responsiveness, thereby enabling a loss of thrust applied thereto to be minimized and allowing the time for the hammering element 1 to move in reciprocatory movement to be shortened. By forming the frame 4 of the hammering element 1 from a plastic, it is possible to further reduce the weight of the hammering element 1. In this case, the forward end portion 1a of the hammering element 1 which directly strikes the back of each type of the type wheel may be formed of any known suitable material of higher hardness than plastics.

Figure 9:
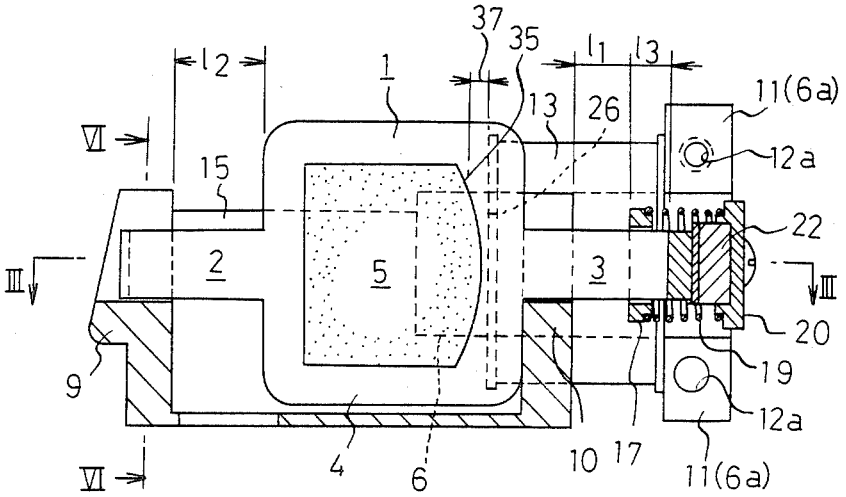
FIG. 9 is a substantially central vertical sectional view of the electromagnetic printing hammer device comprising another embodiment, showing its essential portions.
Figure 10:
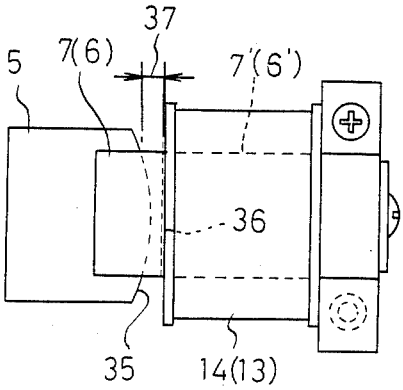
FIG. 10 is a view in explanation of the permanent magnet and the electromagnetic pole-faces of the device shown in FIG. 9.
Figure 11A:
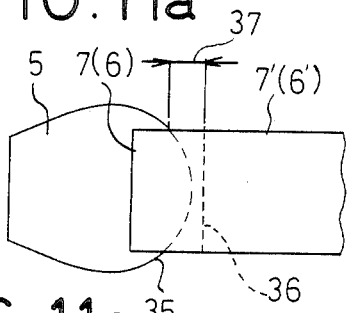
FIGS. 11*a*–11*e* are views in explanation of other examples of the permanent magnet and the electromagnetic polefaces in relation to each other.
Figure 11B:
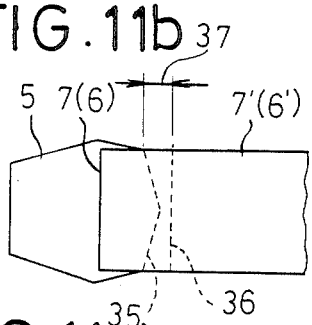
Figure 11C:
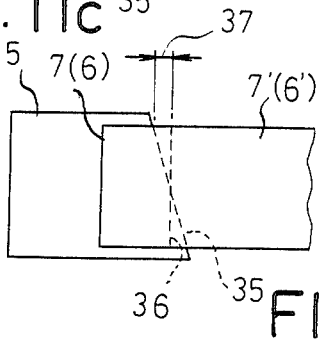
Figure 11D:
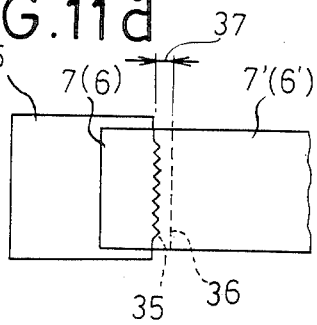
Figure 11E:
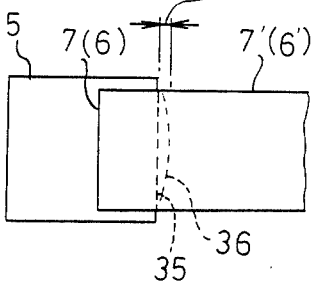

FIGS. 9 and 10 show another embodiment in a substantially central vertical sectional view and a side view showing the permanent magnet and electromagnetic poles in relation to each other, respectively. In this embodiment, a rear end 35 of the permanent magnet 5 is arcuate in shape while a rear end 36 of the pole-faces of the electromagnetic poles 6 and 7 is a straight line, so that a spacing interval 37 of uneven distance is defined between the two ends 35 and 36. The rear end 35 of the permanent magnet 5 cooperating with the rear end 36 of the pole-faces of the electromagnetic poles 6 and 7 to define the spacing interval 37 of uneven distance may have a shape as shown in FIG. 11*a*–11*e*. Additionally, the spacing interval 37 of uneven distance may be constituted by changing the shapes of the ends 35 and 36 from that shown in FIGS. 9 and 10.

The permanent magnet 5 shown in FIG. 9 is constructed such that, when the hammering element 1 is disposed in the rearward standby position or operation commencing position, the rear end 35 of the permanent magnet 5 is located slightly forwardly of the end 36 of the electromagnetic poles 6 and 7. In this case, the displacement between the ends 35 and 36 is such that they define therebetween the aforesaid spacing interval 37 of uneven distance in which portions of the ends 35 and 36 corresponding to each other vary in distance between them. The position in which the hammering element 1 stops by leaving the spacing interval 37 of uneven distance between its end 35 and the end 36 of the pole-faces of the electromagnetic poles 6 and 7 constitutes the operation commencing position of the hammering element 1.

Figure 12:
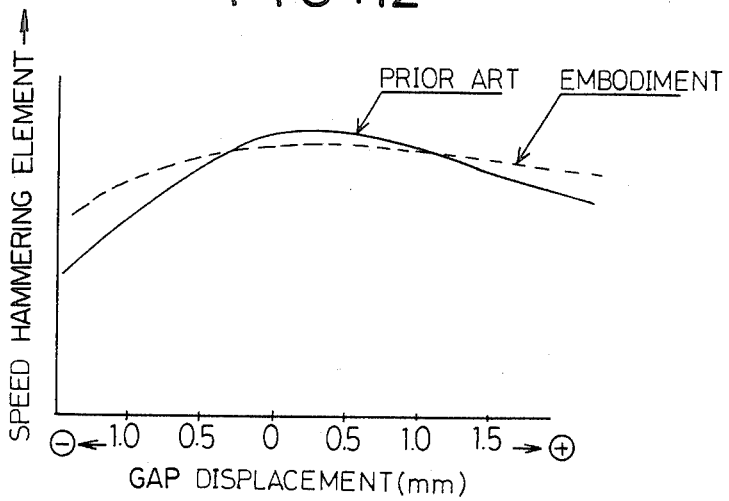
FIG. 12 is a view showing the characteristics of the performance of the hammering element.

The provision of the spacing interval 37 of uneven distance gives the hammering element 1 performance characteristics shown in FIG. 12. In the prior art, the speed of a hammering element was maximized as it is thrusted when the gap g was 0.3 mm, and speed was reduced when the gap g increased and was markedly reduced when there was no gap.

In FIG. 12, it will be seen that in the embodiment of the invention shown and described hereinabove, even if a displacement corresponding to the gap g shown in FIG. 4 shows a change, the provision of the spacing interval 37 of uneven distance allows the speed of the hammering element 1 to be stabilized without showing any fluctuation, thereby stabilizing the performance of the electromagnetic printing hammer device.

The electromagnetic printing hammer device according to the invention is simple in construction and yet enables stabilization of the thrust applied to the hammering element to be positively achieved, and makes it possible to keep the performance of the hammer device stabilized in the event of the occurence of a dimensional error or a change in dimensions, thereby improving the durability of the hammer device.

The electromagnetic printing hammer device according to the invention is constructed and operates as described hereinabove. In this hammer device, the hammering element which is thrusted forwardly as the electromagnetic poles are excited to exert a force of impact is able to increase the force of impact by virtue of the biasing force of the spring which acts on the hammering element in addition to the force of magnetic repulsion. Thus, the hammering element according to the invention is capable of markedly increasing the force of impact exerted thereby as compared with hammering elements of the prior art operated only by the force of magnetic repulsion acting between a permanent magnet and electromagnetic poles excited by a pulse current passed thereto.

The hammering element according to the invention which is also thrusted forwardly by the force of inertia is constructed such that the rear end of the permanent magnet of the hammering element passes through the gap between the electromagnetic poles immediately before the application of the thrust thereto is finished. This is conducive to avoidance of a loss of the force of inertia, thereby enabling the hammering element to exert a force of impact of a maximum intensity level by virtue of the force of magnetic repulsion and the biasing force of the spring cooperating with each other.

Thus, the invention enables power consumption to be reduced for an amount corresponding to a reduction in the value of a pulse current passed to the coils as the force of inertia produced in the hammering element can be utilized.

In the electromagnetic printing hammer device according to the invention, generation of heat by the coils and electromagnetic poles can be suppressed, thereby greatly increasing the practical value of the device as a hammer of the magnetic repulsion type. Since power consumption can be reduced, the capacity of the power source can be reduced, thereby contributing to a reduction in cost.

In the electromagnetic printing hammer device according to the invention, when it is not an essential requirement to reduce power consumption, it is possible to positively increase the force of impact exerted by the hammering element by passing a pulse current of a value usually used in the prior art to the coils.

Meanwhile, by varying the stroke performed by the biasing force of the spring, it is possible to positively control the force of impact exerted by the hammering element, thereby facilitating design and production of the magnetic printing hammer device.

According to the invention, the yokes constituting a magnetic path for the coils and electromagnetic poles extend in the same direction as the direction in which the hammering element exerts a force of impact, as viewed from one side of the hammer device. This prevents the sliding movement of the hammering element from being interfered with by a leak magnetic flux of the coils.

From the foregoing description, it will be appreciated that the invention enables the time during which the hammering element moves in reciprocatory movement to be shortened and allows the speed at which the hammering element responds to the magnetism to be increased. The advantages offered by the invention include an improved performance testified to by an increased number of prints produced per unit time, and a minimized loss of the energy of impact attributable to the linear movement of the hammering element, thereby greatly increasing the practical value of the device.

What is claimed is:

1. An electromagnetic printing hammer device for impacting the back of a type element comprising:

an electromagnetic having coils and a pair of electromagnetic pole-faces spaced apart from each other by a gap;

a hammering element including a permanent magnet mounted in at least one portion thereof and located in said gap for linear movement in a plane parallel to said electromagnetic pole-faces, said hammering element having a thrust applied thereto as a pulse current is applied to the electromagnet coils so as to exert a force of impact in a forward direction on the back of a type element, said hammering element having front and rear shaft portions;

a pair of bearings which journal said hammering element at the front and rear shaft portions respectively for forward and backward movement of said hammering element, wherein the bearing for the rear shaft portion has a rear surface;

a spring mounted in the device to exert a biasing force on the hammering element in a ready position and to urge the hammering element forwardly when the thrust of the electromagnet is applied thereto so as to increase the force of impact exerted thereby on a type element;

wherein said hammering element and pole-faces of said electromagnet are disposed so that when said electromagnet is not energized, a magnetic attraction occurs between said permanent magnet and said pole-faces which is stronger than the biasing force of the spring to hold the hammering element in the ready position, and when said electromagnet is energized, said hammering element is driven by both a repulsive force between said permanent magnet and said pole-faces of said electromagnet and the biasing force of the spring; and stopping means for stopping said biasing force of said spring without stopping the inertia force of said hammering element, wherein said stopping means is formed by said rear surface of said bearing for said rear shaft portion of said hammering element.

2. The electromagnetic printing hammer device as described in claim 1, wherein said permanent magnet of said hammering element in the ready position has its rear end spaced forwardly of the rear ends of said pole-faces by a pre-determined displacement.

3. The electromagnetic printing hammer device as described in claim 2, wherein said permanent magnet is arranged so that its rear end passes through the gap between said pole-faces at least immediately before the exertion of the force of impact by the hammering element on the type element is completed.

4. The electromagnetic printing hammer device as described in claim 1, wherein said electromagnet includes a pair of yokes extending linearly and having at their ends said electromagnetic pole-faces, and a pair of coils each wound on a respective one of said pair of yokes, and wherein said hammering element is arranged for linear movement aligned with said pair of yokes.

5. The electromagnetic printing hammer device as described in claim 1, wherein said permanent magnet and said pole-faces have respective heights, and the height of said permanent magnet is greater than the height of said pole-faces in a direction perpendicular to the direction of linear movement of said permanent magnet.

6. The electromagnetic printing hammer device as described in claim 1, wherein said permanent magnet is formed of a plastic magnet.

7. The electromagnetic printing hammer device as described in claim 1, including a movable rest element associated with said spring and disposed at a forward end of the spring in which an end portion of said hammering element is carried and, when said electromagnet is energized, said rear end portion of said hammering element is impelled forward by said rest element under the biasing force of the spring for a distance L1 which is less than the total distance of travel L2 of the hammering element from the ready position to the completion of impact of a forward end portion of the hammering element with the type element.

* * * * *